US006899586B2

(12) United States Patent
Davis

(10) Patent No.: US 6,899,586 B2
(45) **Date of Patent: *May 31, 2005**

(54) SELF-STABILIZING ROTATING TOY

(76) Inventor: Steven Davis, Suite 701-3 Wing On Plaza, 62 Mody Road, TST East (HK)

( * ) Notice: Subject to any disclaimer, the term of this patent is extended or adjusted under 35 U.S.C. 154(b) by 0 days.

This patent is subject to a terminal disclaimer.

(21) Appl. No.: 10/924,357

(22) Filed: Aug. 24, 2004

(65) Prior Publication Data

US 2005/0026534 A1 Feb. 3, 2005

Related U.S. Application Data

(63) Continuation of application No. 10/647,930, filed on Aug. 26, 2003, now Pat. No. 6,843,699, which is a continuation-in-part of application No. 09/819,189, filed on Mar. 28, 2001.

(60) Provisional application No. 60/453,283, filed on Mar. 11, 2003.

(51) Int. Cl.[7] ..... A63H 27/127

(52) U.S. Cl. ..... 446/37; 446/46; 244/23 C

(58) Field of Search ..... 446/34, 36, 37, 446/46, 48; 244/12.2, 23 C, 23 R

(56) References Cited

U.S. PATENT DOCUMENTS

| | | | | | |
|---|---|---|---|---|---|
| 2,949,693 | A | * | 8/1960 | McRoskey | 446/37 |
| 3,394,906 | A | * | 7/1968 | Lester | 244/23 R |
| 3,935,663 | A | * | 2/1976 | Leibowitz | 446/48 |
| 4,313,512 | A | * | 2/1982 | Jutras | 180/117 |

* cited by examiner

*Primary Examiner*—Bena Miller

(57) ABSTRACT

A rotating toy may then include a hub having a central axis and a lower portion; a plurality of counter rotating blades extending outwardly from the lower portion of the hub, the plurality of counter rotating blades having a tip connected to an outer ring; a single means for rotating the hub and blades sufficiently quickly to generate a major portion of the lift generated by the aircraft through the single rotating means; and the hub having an upper portion above the plurality of counter rotating blades and above the single rotating means such that the aircraft includes a center of gravity above a bottom portion defined by the outer ring to improve self stabilization of the toy. In furtherance thereto the single rotating means may be secured on the central axis and positioned below the counter rotating blades.

10 Claims, 6 Drawing Sheets

SELF-STABILIZING ROTATING TOY

CROSS REFERENCE TO RELATED APPLICATIONS

This application is a continuation of Ser. No. 10/647,930 filed Aug. 26, 2003, now U.S. Pat. No. 6,848,699 which claims the benefit of provisional application 60/453,283 filed on Mar. 11, 2003, and which is a continuation in part application of Ser. No. 09/819,189 filed Mar. 28, 2001.

FIELD OF THE INVENTION

This invention relates generally to toys and more particularly to directionally uncontrollable self-stabilizing rotating toys.

BACKGROUND OF THE INVENTION

Most vertical takeoff and landing aircraft rely on gyro stabilization systems to remain stable in hovering flight. For instance, applicant's previous U.S. Pat. No. 5,971,320 and International PCT application WO 99/10235 discloses a helicopter with a gyroscopic rotor assembly. The helicopter disclosed therein uses a yaw propeller mounted on the frame of the body to control the orientation or yaw of the helicopter. However, different characteristics are present when the body of the toy, such as a flying saucer model, rotates as gyro stabilization systems may not be necessary when the body rotates, for example, see U.S. Pat. Nos. 5,297,759; 5,634,839; 5,672,086; and co-pending co-assigned U.S. patent application Ser. No. 09/819,189.

However, a great deal of effort is made in the following prior art to eliminate or counteract the torque created by horizontal rotating propellers in flying aircraft in order to replace increased stability by removing gyro-stabilization systems. For example, Japanese Patent Application Number 63-026355 to Keyence Corp. provides a first pair of horizontal propellers reversely rotating from a second pair of horizontal propellers in order to eliminate torque. See also U.S. Pat. No. 5,071,383 which incorporates two horizontal propellers rotating in opposite directions to eliminate rotation of the aircraft. Similarly, U.S. Pat. No. 3,568,358 discloses means for providing a counter-torque to the torque produced by a propeller because, as stated in the '358 patent, torque creates instability as well as reducing the propeller speed and effective efficiency of the propeller.

The prior art also includes flying or rotary aircraft which have disclosed the ability to stabilize the aircraft without the need for counter-rotating propellers. U.S. Pat. No. 5,297,759 incorporates a plurality of blades positioned around a hub and its central axis and fixed in pitch. A pair of rotors pitched transversely to a central axis to provide lift and rotation are mounted on diametrically opposing blades. Each blade includes turned outer tips, which create a passive stability by generating transverse lift forces to counteract imbalance of vertical lift forces generated by the blades, which maintains the center of lift on the central axis of the rotors. In addition, because the rotors are pitched transversely to the central axis to provide lift and rotation, the lift generated by the blades is always greater than the lift generated by the rotors.

Nevertheless, there is always a continual need to provide new and novel self-stabilizing rotating toys that do not rely on additional rotors to counter the torque of a main rotor. Such a need should include a single main rotor to generate a major portion of the lift. Such self-stabilizing rotating toys should be inexpensive and relatively noncomplex.

SUMMARY OF THE INVENTION

In accordance with the present invention a self-stabilizing rotating flying toy that includes a main rotor is attached to a main body with a plurality of blades fixed with respect to the main body. The blades and main body rotate in a opposite direction caused by the torque of a motor mechanism used to rotate the main rotor positioned below the blades. The blades extend from a inner hub to an outer ring. The main hub connected above the inner hub is positioned above the blades and main body such that the Center of Gravity is above the center of lift, to provide a self-stabilizing rotating toy.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
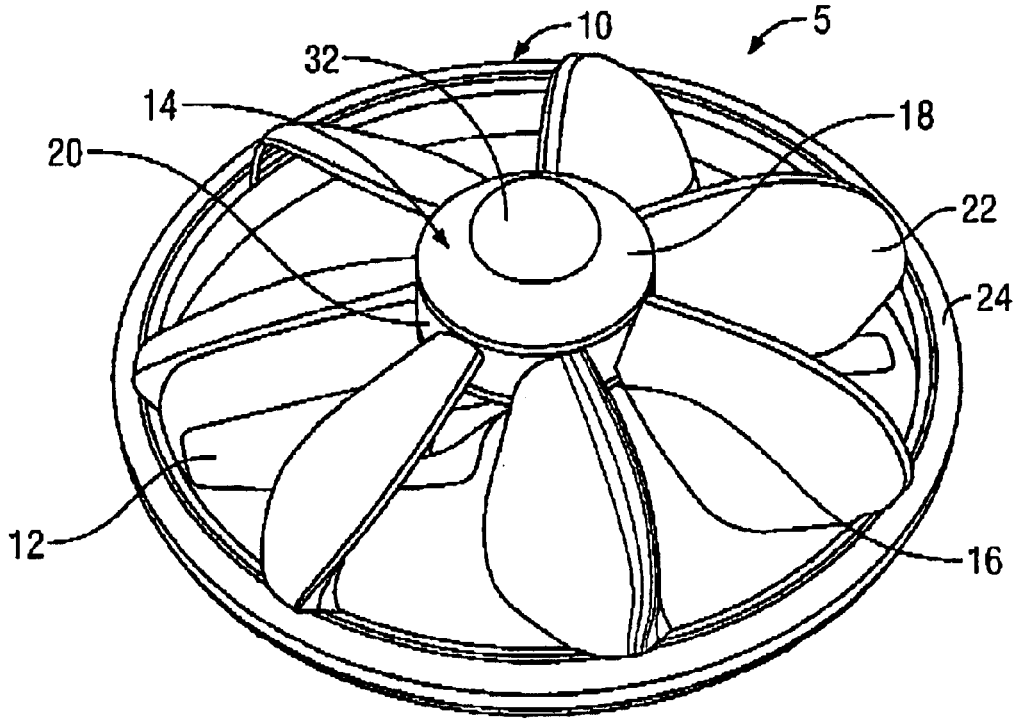
FIG. 1 is a perspective view of a flying rotating toy in accordance with the preferred embodiment of the present invention.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
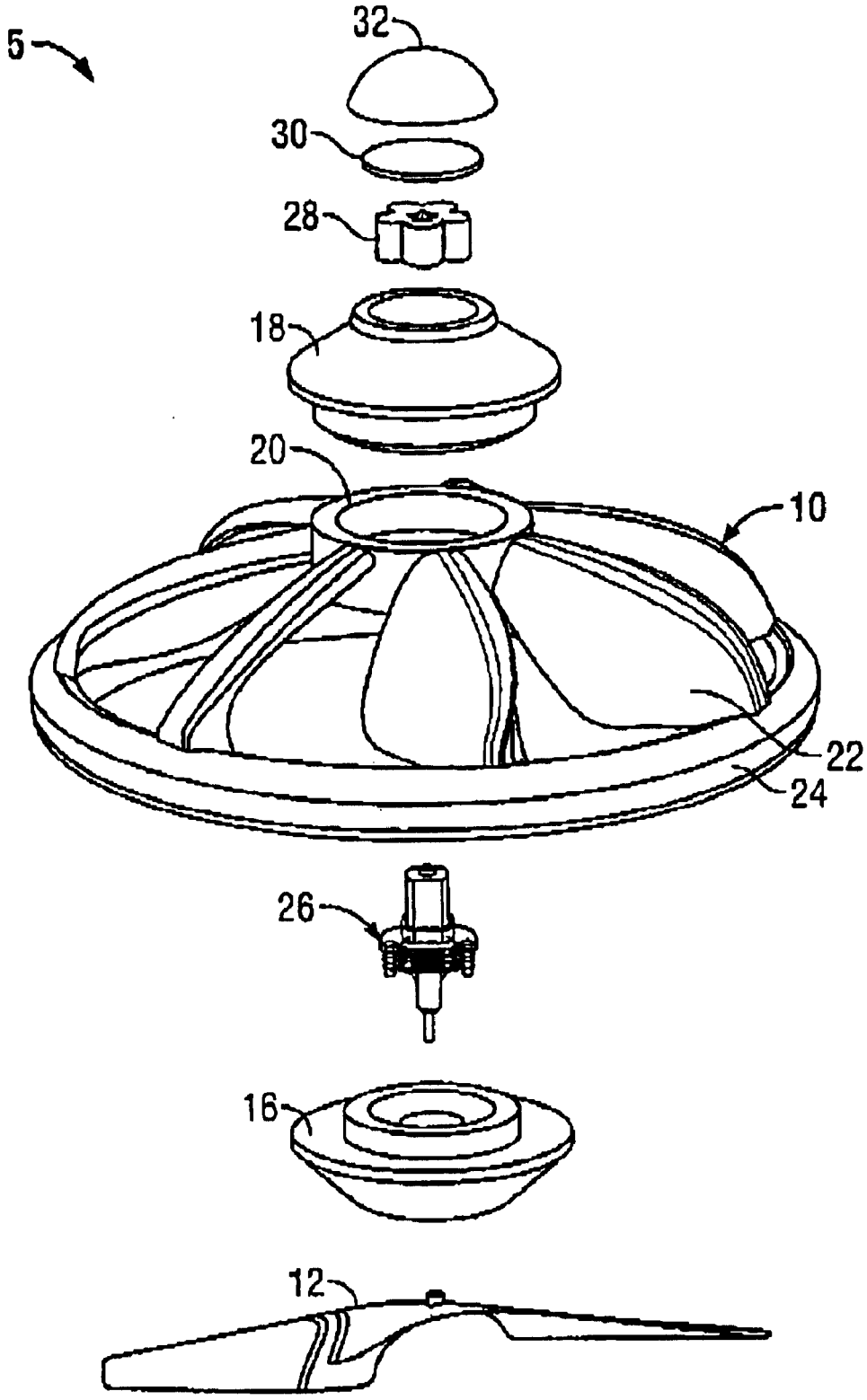
FIG. 2 is an exploded view of the flying rotating toy from FIG. 1.

Referring to FIGS. 1 and 2, in a first embodiment of the present invention a flying rotating toy 5 is provided. The rotating toy 5 includes a single main rotor 12 rotatably attached to a light weight counter rotating main body 10. The counter rotating main body 10 includes a hub 14 that contains the drive and control mechanisms. The hub 14 is defined as having a lower hub section 16 and an upper hub section 18 that are received by an inner hub 20. A plurality of blades 22 extend outwardly and downwardly from the hub 14 to an outer ring 24. The lower hub section 16 houses a motor mechanism 26 that is used to rotate a main rotor 12, while the upper hub section 18 houses at least a power supply 28 and a circuit board 30. A clear dome 32 is positioned on top of the upper hub section 18 to protect the components and to provide a means for the reception of wireless signals, discussed in greater detail below.

Figure 3:
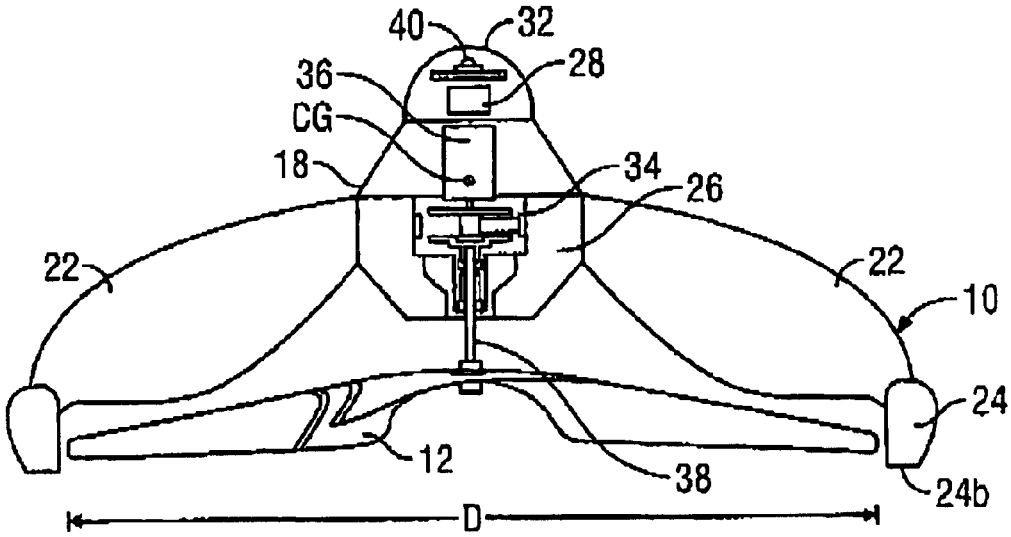
FIG. 3 is a sectional view of the flying rotating toy from FIG. 1.

Further reference is made to the cross sectional view of the rotating toy 5 illustrated in FIG. 3. The motor mechanism 26 is a planetary reduction gear box 34 that includes a motor 36. The planetary gear box 34 permits the motor mechanism 26 to be mounted along a single axis aligned with an axle 38 that is connected to the main rotor 12.

Figure 4:
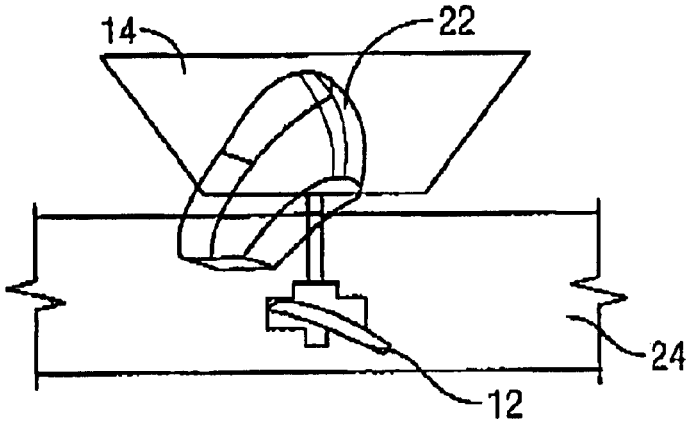
FIG. 4 is a partial sectional view of the relationship between the counter rotating blades and the main rotor.

As the main rotor 12 rotates, no attempt is made to counter the torque from driving the main rotor 12, instead the torque causes the main body 10 to rotate in the opposite direction. Once the toy is flying the outer ring 24 protect the main rotor 12 and provides gyroscopic stability. As mentioned above, the outer ring 24 and hub 14 are connected by a plurality of blades 22 with lifting surfaces positioned to generate lift as the toy 5 rotates. Since the blades 22 are rotating in the opposite direction as the main rotor 12 but both are providing lift to the toy 5, the blades 22 are categorized as counter-rotating lifting surfaces. (The interrelationship between the counter rotating blades and the main rotor is illustrated in partial sectional view FIG. 4.) The induced drag characteristics of the main rotor 12 verses the blades 22 can also be adjusted to provide the desired body rotation speed.

The rotating toy 5 of the present invention has the ability to self stabilize during rotation. This self stabilization is categorized by the following: as the rotating toy 5 is perturbed in someway it tilts to one direction and starts moving in that direction. A blade, of the plurality of blades 22, that is on the higher or preceding side of the rotating toy (since the rotating toy is tilted) will get more lift that the one on the lower or receding side. This happens because the preceding blade will exhibit a higher inflow of air. Depending on the direction of rotation the lift is going to be on one side or the other. This action provides a lifting force that is 90 degrees to the direction of travel and creates a gyroscopic procession with a reaction force that is 90 degrees out of phase with the lifting force such that the rotating toy 5 self-stabilizes. The self-stabilizing effect is thus caused by the gyroscopic procession and the extra lifting force on the preceding blade. For the self-stabilizing effect to work the gyroscopic procession forces generated by the rotating body must dominant over the gyroscopic procession forces generated by the main propeller 12.

The placement of the center of gravity (CG, FIG. 3) above the center of lift was found to be very critical for the self-stabilizing effect. Experiments showed that the self-stabilizing effect depended on the aerodynamic dampening and on the relative magnitudes of the aforementioned forces. It was thus determined that the self-stabilizing effect was best when the CG is positioned above the bottom position 24*b* of the outer ring 24, preferably at a distance which is equal to about ⅓ to ½ the diameter D of the main rotor 12 and most preferred when the distance is about 65% of the main rotor 12 radius (½ D). (It is noted that the diameter of the main rotor 12 is equal to the length of the two blades, from tip to tip). It should also be noted that the cross sectional shape of the outer ring 24 and the height of the CG is inter dependent and very critical to the stability. It was also found that if the CG is higher, the rotating toy 5 becomes unstable and if the CG is lower, the rotating toy becomes unstable. And if the rotating toy 5 becomes unstable, the rotating toy will not self stabilize, meaning that it will just spiral further and further out of control as the rotating toy 5 flies off into a larger and larger oscillations.

Since it is most preferred to place the CG about 65% of the main rotor radius above the bottom of the outer ring 24, most of the components are placed above the main body 10. The motor 36 thus drives the main rotor 12 through a longer driveshaft. In addition, the weight contributes to the CG placement, thus, it is preferred to have the main body 10 including the blades 22 made from a light weight material.

The present invention is also particularly stable because there is a large portion of aerodynamic dampening caused by the blades 22. As mentioned above, the entire blades 22 are curved and turned downwardly from the hub 14 to an outer ring 24, and preferably inclined downwardly at about 20 to 30 degrees, which may be measured by drawing an imaginary line through an average of the curved blades. This causes dampening that resists sideward motion in the air because there's a large frontal area to the blades.

During operation, the main rotor 12 is spinning drawing the air above the toy downwardly through the counter rotating blades 22 within the outer ring 24. The air is thus being conditioned by the blades before hitting the rotor. By conditioning the air it is meant that the air coming off the blades 22 is at an angle and at an acceleration, as opposed to placing the main rotor in stationary air and having to accelerate the air from zero or near zero. The efficiency of the main rotor 12 is thereby increased. It was found that the pitch on the main rotor 12 would have to be a lot shallower if the blades 22 were not positioned above the main rotor.

During various experiments the main rotor 12 and the main body 10 were rotated separately and together at about 600 rpms and the lift generated by the main rotor 12 and main body 10 were measured. It was found that when rotated separately, the main rotor 12 only generated about 60% of the lift exhibited by the combination of the main rotor 12 and the body 10 (with blades 22). However, it would be incorrect to state that the blades 22 generate the remaining 40% of the lift, because it was also found that the blades 22 spinning at the same speed by themselves only generated about 5 to 10% of the lift exhibited by the combination. Since separately the main rotor generated 60% and the blades generated 5 to 10% there is 30–35% of lift unaccounted. However, when the main rotor 12 is rotating separately the air that it is using is unconditioned or static (zero acceleration). Since the blades 22 are positioned on top of the main rotor 12, the blades 22 will still only generate 5–10% of the lift in the combined state; concluding that the blades 22 increase the efficiency of the main rotor by conditioning the air before it is used by the main rotor 12. Thus the combination of the two (the main rotor 12 and the blades 22) must generate the additional 30–35% of the lift when acting in concert and utilizing the conditioned air.

Figure 5:
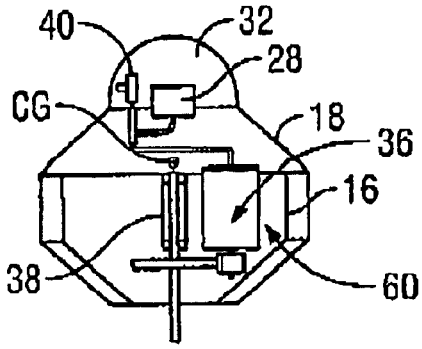
FIG. 5 is a cross sectional view of another gear reduction box which may be incorporated by the present invention illustrating a dome section with a off-center motor placement.

In another embodiment, an offset reduction gear box 60 (FIG. 5) may also be used that have an offset motor 36 mounted off of the axle 38. In an offset mount, a counterweight (not shown) may be placed on the outer ring 24 about 180 degrees from the motor, to keep the balance of the rotating toy centered.

Figure 6:
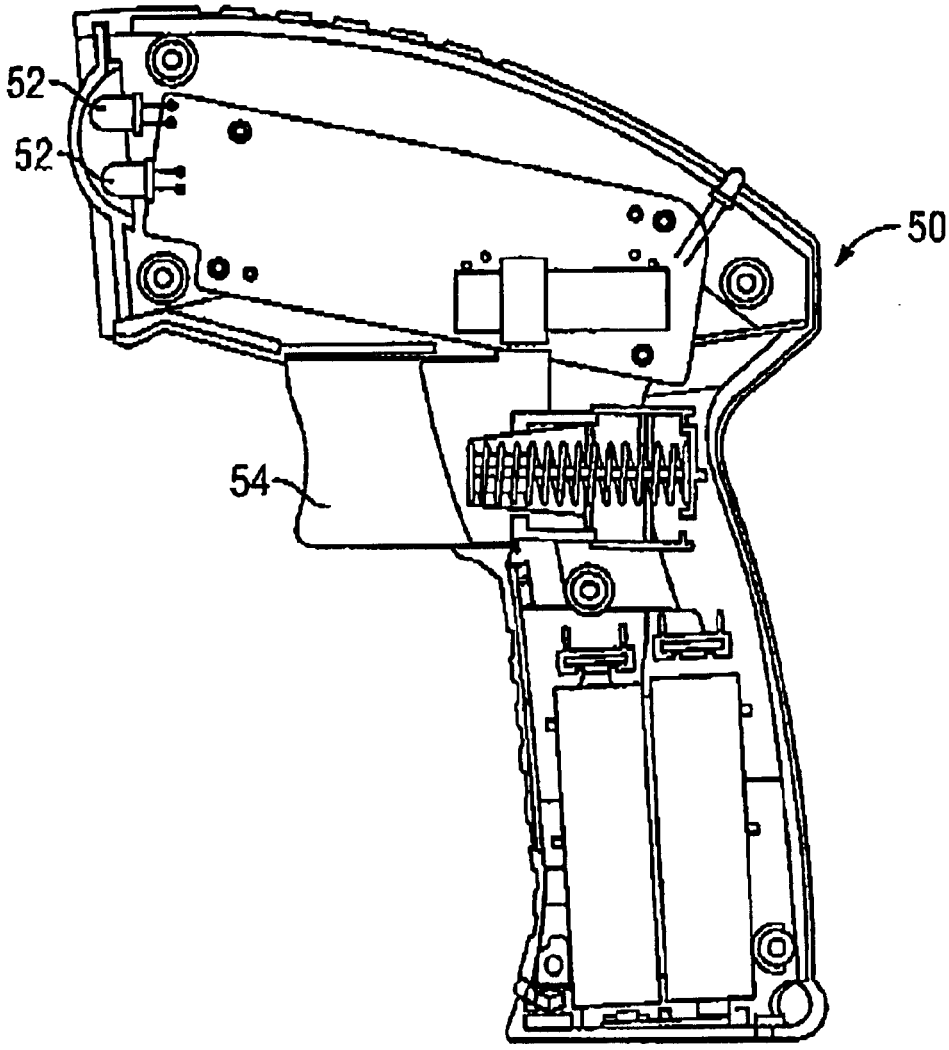
FIG. 6 is a cross sectional view of a trigger mechanism designed to remotely control the speed of the motor mechanism.
Figure 7:
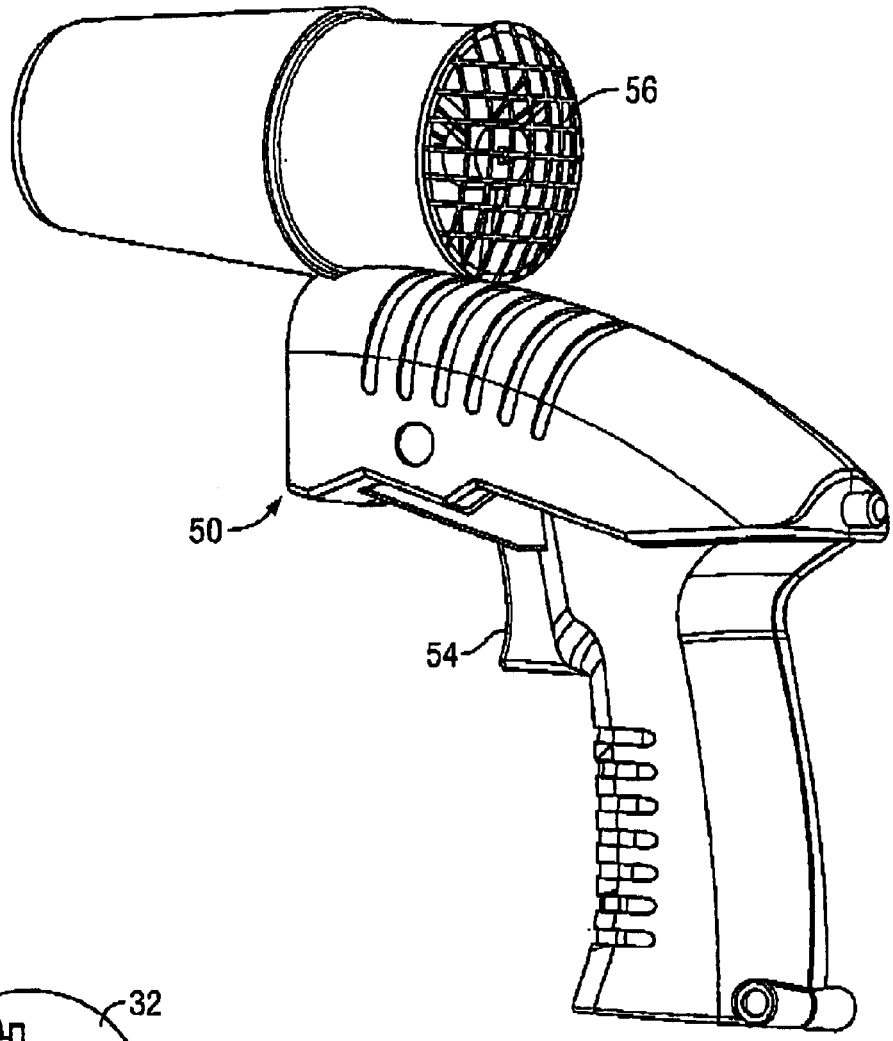
FIG. 7 is another trigger mechanism incorporating a fan or blower to move the rotating toy during operation.

To control the motor mechanism 26 an IR sensor 40 or receiver is positioned in the dome 32 and is used in concert with an outside remote IR transmitter. The transmitter 52 may be positioned in a remote control unit 50, illustrated in FIG. 6. The remote control unit 50 has a simple trigger mechanism 54 designed to emit a signal when pushed inwardly by the user's finger. In addition, the self stabilizing effect will cause the rotating toy 5 to stabilize even when pushed by air currents, which will initially move the rotating toy 5 but eventually the toy 5 will stabilize to a substantially horizontal flying position. Referring to FIG. 7, the remote control mechanism 50 may include a fan 56 that is able to be activated by the user. Activating the fan 56 will permit the user to blow a stream of air at the rotating toy 5 and push it around, providing a simple means of moving the rotating toy around. It is well known in the art and contemplated by the present invention that the transmitter and receivers can be radio, infrared or optical.

Figure 9:
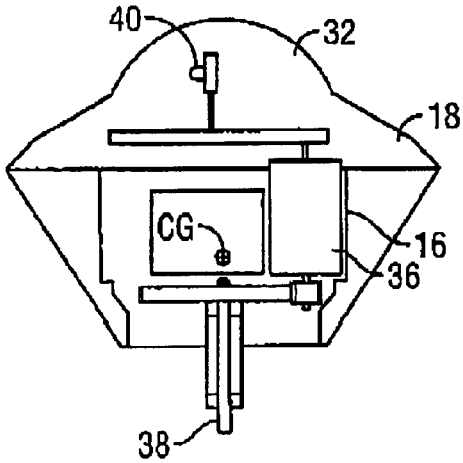
FIG. 9 shows a cross section view of a gear reduction box used in the embodiment of FIG 8.
Figure 8:
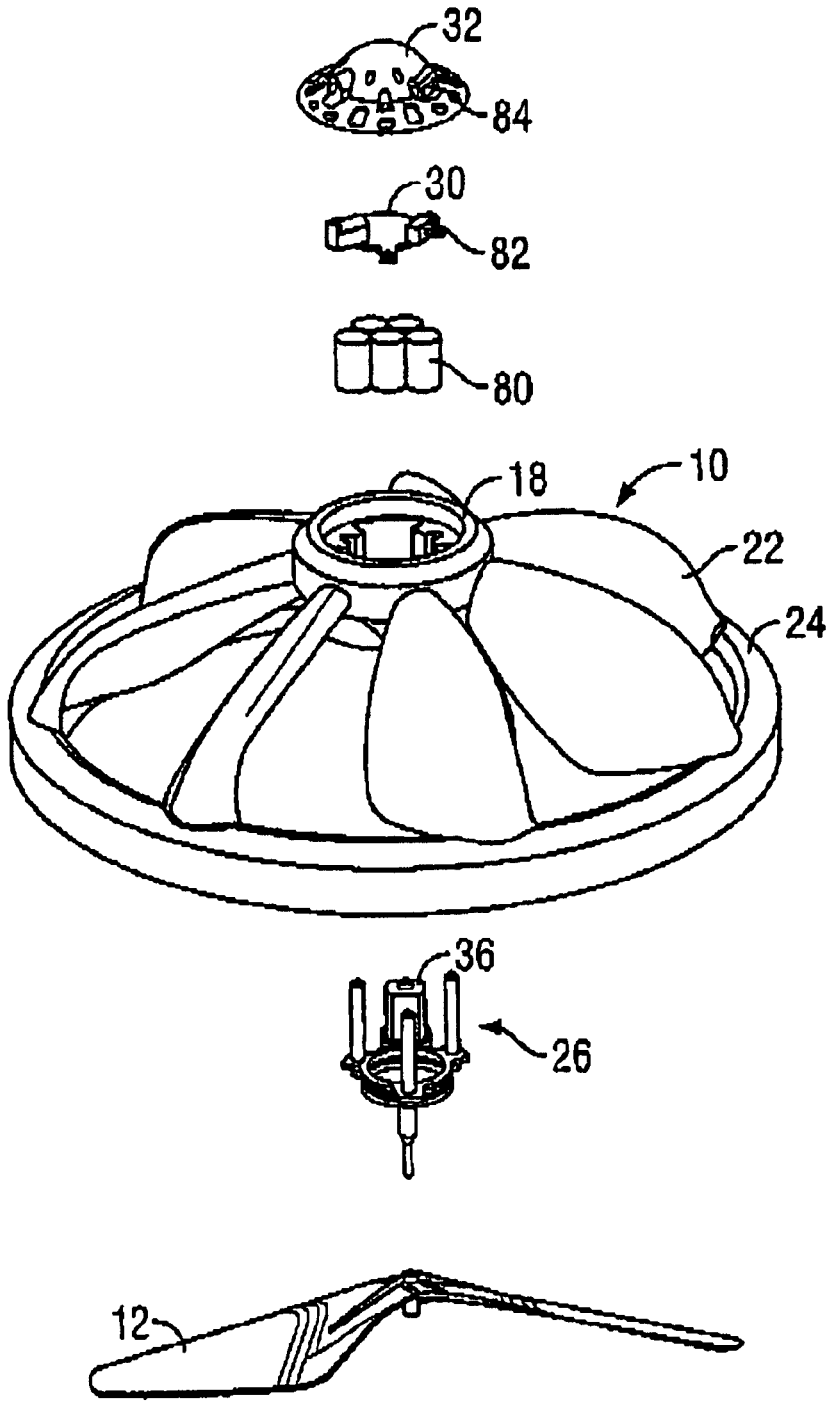
FIG. 8 shows an exploded perspective view of another embodiment of the present invention.

In another embodiment of the present invention, referred to FIGS. 8 and 9, a battery pack 80 is used to counter the weight of an offset motor 36. As illustrated, the battery pack 80 is arranged such that a motor 36 in the motor mechanism 26 is offset to counter balance each other such that the rotating toy is balanced. Moreover, in this embodiment the upper hub section 18 and the lower hub section 16 are integrally formed as a single piece; and an on/off switch 82 is attached to the circuit board 30 and positioned to be manipulated by a user through an aperture 84 in the dome 32.

It should be further stated the specific information shown in the drawings but not specifically mentioned above may be ascertained and read into the specification by virtue of simple study of the drawings. Moreover, the invention is also not necessary limited by the drawings or the specification as structural and functional equivalents may be contemplated and incorporated into the invention without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

I claim:

1. A rotating toy comprising: a hub having a central axis and a center portion; a plurality of counter rotating lifting blades extending outwardly from the center portion of the hub, the plurality of counter rotating lifting blades having a tip connected to an outer ring; a single means for rotating the hub and blades sufficiently to generate a major portion of the lift through the single rotating means; and the hub having an upper portion above the plurality of counter rotating blades and above the single rotating means such that the toy includes a center of gravity above a bottom portion of the outer ring to improve self stabilization of the toy.

2. The rotating toy of claim 1, wherein the single rotating means is secured on the central axis and positioned below the counter rotating blades.

3. The rotating toy of claim 2, wherein the single rotating means is a pair of main blades secured on said central axis, the pair of main blades include a total length that defines a diameter of the single rotating means.

4. The rotating toy of claim 3, wherein the center of gravity that is positioned above a bottom portion defined by the outer ring at a distance that is between about ⅓ to ½ the diameter defined by the pair of main blades.

5. The rotating toy of claim 3, wherein the center of gravity that is positioned above a bottom portion defined by the outer ring at a distance that is about 65% of one-half the diameter defined by the pair of main blades.

6. A rotating toy comprising:

a hub having a lower portion, an upper portion and a center portion;

a plurality of counter rotating lifting blades extending outwardly and downwardly from the center portion of the hub;

an outer ring having a bottom portion and being positioned below the center portion of the hub and connected to the plurality of counter rotating lifting blades;

a main pair of blades secured on an axle and positioned below the plurality of counter rotating lifting blades, the pair of main blades include a total length that defines a diameter of the main pair of blades;

a motor mechanism secured within the lower portion of the hub and when activated rotates the axle, wherein when the motor mechanism is activated the main pair of blades rotate in a first direction and the torque created by the rotation thereof rotates the counter rotating lifting blades in a direction opposite the first direction; and the upper portion of the hub is positioned above the plurality of counter rotating lifting blades such that a center of gravity defined by the toy is positioned above the bottom portion of the outer ring to improve self stabilization of the toy.

7. The rotating toy of claim 6, wherein the distance the center of gravity is above the bottom portion is about 65% of one-half the diameter of the main pair or blades.

8. The rotating toy of claim 7, wherein the plurality of counter rotating lifting blades extend downwardly at about 20 to 30 degrees.

9. A rotating toy in combination with a remote control mechanism comprising:

the rotating toy including a hub having an upper portion, center portion and a lower portion; a plurality of counter rotating lifting blades extending outwardly and downwardly from the center portion of the hub to an outer ring positioned below the upper portion of the hub; a motor mechanism secured to the hub for rotating an axle, a pair of main blades secured to the axle below the counter rotating lifting blades, wherein when the motor mechanism rotates the main blades and the counter rotating lifting blades, the counter rotating lifting blades condition the air such that a major portion of lift generated by the rotating toy is generated by the main blades;

the rotating toy further including a receiver in communication with the motor mechanism to receive commands for controlling a rotational speed of the rotating toy, and further including a center of gravity positioned above a bottom portion defined by the outer ring to improve self stabilization of the toy; and the remote control mechanism including a transmitter for sending commands to the receiver that control the rotational speed of the rotating toy.

10. The combination of claim 9, wherein:

the rotating toy is made of a light weight foam material such that the rotating toy is susceptible to being moved by air currents, and the remote control mechanism includes a fan activated by said remote control mechanism for blowing air towards the rotating toy.

* * * * *